US010010179B1

(12) United States Patent
Stump et al.

(10) Patent No.: US 10,010,179 B1
(45) Date of Patent: Jul. 3, 2018

(54) COLLAPSIBLE FURNITURE

(71) Applicants: John Stump, Santa Barbara, CA (US); Sam Chesluk, Santa Barbara, CA (US)

(72) Inventors: John Stump, Santa Barbara, CA (US); Sam Chesluk, Santa Barbara, CA (US)

( * ) Notice: Subject to any disclaimer, the term of this patent is extended or adjusted under 35 U.S.C. 154(b) by 0 days.

(21) Appl. No.: 15/667,341

(22) Filed: Aug. 2, 2017

(51) Int. Cl.

| | |
|---|---|
| ***A47C 4/20*** | (2006.01) |
| ***A47C 4/44*** | (2006.01) |
| ***A47C 17/04*** | (2006.01) |
| ***A47C 4/28*** | (2006.01) |

(52) U.S. Cl.
CPC ..... *A47C 4/286* (2013.01); *A47C 4/20* (2013.01); *A47C 4/44* (2013.01); *A47C 17/04* (2013.01)

(58) Field of Classification Search
CPC ..... A47C 4/20; A47C 4/44; A47C 4/286
USPC ..... 297/16.2; 248/171, 435
See application file for complete search history.

(56) References Cited

U.S. PATENT DOCUMENTS

| | | | | | |
|---|---|---|---|---|---|
| 1,344,431 | A * | 6/1920 | Albertie | A47C 4/286 | 248/435 |
| 1,422,319 | A * | 7/1922 | Stoll | A47C 4/286 | 248/435 |
| 3,709,167 | A * | 1/1973 | Sprigman | A47C 4/286 | 108/128 |
| 4,258,951 | A * | 3/1981 | Groom | A47C 4/286 | 297/16.2 |
| 4,666,112 | A * | 5/1987 | Jaumann | F16M 11/28 | 248/169 |
| 4,671,566 | A * | 6/1987 | Knapp | A47C 4/286 | 248/188.6 |
| 4,934,638 | A * | 6/1990 | Davis | A47C 4/286 | 108/118 |
| 5,421,549 | A * | 6/1995 | Richards | F16M 11/10 | 248/163.2 |
| 6,135,557 | A * | 10/2000 | Gustafsson | A47C 4/286 | 108/118 |
| 7,384,097 | B2 * | 6/2008 | Park | A47C 4/286 | 297/16.1 |
| 7,740,309 | B2 * | 6/2010 | Mayercheck | A47C 4/14 | 297/16.1 |
| 9,510,683 | B1 * | 12/2016 | Sharp | A47C 7/008 | |
| 2011/0061573 | A1 * | 3/2011 | Wright | A47B 3/0818 | 108/132 |
| 2012/0274107 | A1 * | 11/2012 | Chesness | A47C 4/286 | 297/188.14 |

* cited by examiner

*Primary Examiner* — David R Dunn
*Assistant Examiner* — Tania Abraham
(74) *Attorney, Agent, or Firm* — Lyman Smith; Patent Service Associates, Inc.

(57) ABSTRACT

A collapsible furniture item, such as a chair or stool, can be easily interconverted between an in-use, or deployed, configuration and a stowed configuration. A single push button may be used to cause the legs of the furniture to automatically deploy from the stowed configuration. A latch on each leg may retain the furniture in either the deployed or the stowed configurations. Arms may pivotably extending from the legs to form a seat of a chair or stool, or a top of a table, for example. The arms may telescope to form different configurations for the chair. When stowed, at least a portion of the arms are disposed within a channel formed by the legs, resulting in a compact stowed configuration. In the stowed configuration, multiple devices may join together for ease of transportation.

15 Claims, 12 Drawing Sheets

COLLAPSIBLE FURNITURE

BACKGROUND OF THE INVENTION

1. Field of the Invention

One or more embodiments of the invention relates generally to collapsible furniture. More particularly, the invention relates to a collapsible chair or table that can convert between a folded, stowed configuration and a deployed, in-use configuration.

2. Description of Prior Art and Related Information

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Most portable chairs today are large, bulky and take up valuable storage space. Moreover, many conventional portable chairs are difficult to set up and, once set up, difficult to stow. Some portable chairs require several steps to set up and/or stow. This makes it inconvenient to bring portable chairs to places while on the go.

Similarly, portable tables are often bulky and take up significant storage space. While collapsible tables are known in the art, these tables often take multiple steps for assembly and can be difficult to assembly by oneself.

In view of the foregoing, there is a need for portable furniture, such as chairs and tables, that may store in a relatively small space, may be quickly and easily deployed, and may quickly and easily be stored after deployment.

SUMMARY OF THE INVENTION

Embodiments of the present invention provide a collapsible furniture item, comprising a central hub; a plurality of legs pivotably attached to the central hub, the plurality of legs movable between a stowed position, where each leg of the plurality of legs is disposed adjacent each other, and a deployed position, where the plurality of legs support the central hub above a surface; a plurality of arms pivotably attached to the plurality of legs, proximate the central hub, the plurality of arms disposed at least partially inside a channel formed by the plurality of legs in the stowed position, the plurality of arms extending outward from the plurality of legs in the deployed position; and a push button operable to release a stopper from a stowed position catch formed in each of the legs, wherein depression of the push button, when in the stowed position, causes the plurality of legs to automatically deploy and move to a deployed position.

Embodiments of the present invention further provide a collapsible chair, comprising a central hub; a plurality of legs pivotably attached to the central hub, the plurality of legs movable between a stowed position, where each leg of the plurality of legs is disposed adjacent each other, and a deployed position, where the plurality of legs support the central hub above a surface; a leg spring disposed against each of the plurality of legs, the leg spring resiliently urging the legs into the deployed position; a plurality of arms pivotably attached to the plurality of legs, proximate the central hub, the plurality of arms disposed at least partially inside a channel formed by the plurality of legs in the stowed position, the plurality of arms extending outward from the plurality of legs in the deployed position; an arm spring disposed against each of the plurality of arms, the arm spring resiliently urging the arms into the deployed position; a seat attached to distal ends of each of the plurality of arms; and a push button operable to release a stopper from a stowed position catch formed in each of the legs, wherein depression of the push button, when in the stowed position, causes the plurality of legs to automatically deploy and move to a deployed position.

In some embodiments, the legs include a deployed position catch to receive the stopper and retain the legs in the deployed position.

In some embodiments, a push button spring urges the stopper to engage with the stowed position catch.

In some embodiments, at least a portion of the arms are telescoping arms.

In some embodiments, a back support members of the arms extend a first length longer than a second length of the seat support members of the arms.

In some embodiments, the legs are formed in a C-shape and the arms fit at least partially into the interior of the C-shape when in the stowed position.

These and other features, aspects and advantages of the present invention will become better understood with reference to the following drawings, description and claims.

BRIEF DESCRIPTION OF THE DRAWINGS

Some embodiments of the present invention are illustrated as an example and are not limited by the figures of the accompanying drawings, in which like references may indicate similar elements.

Figure 1:
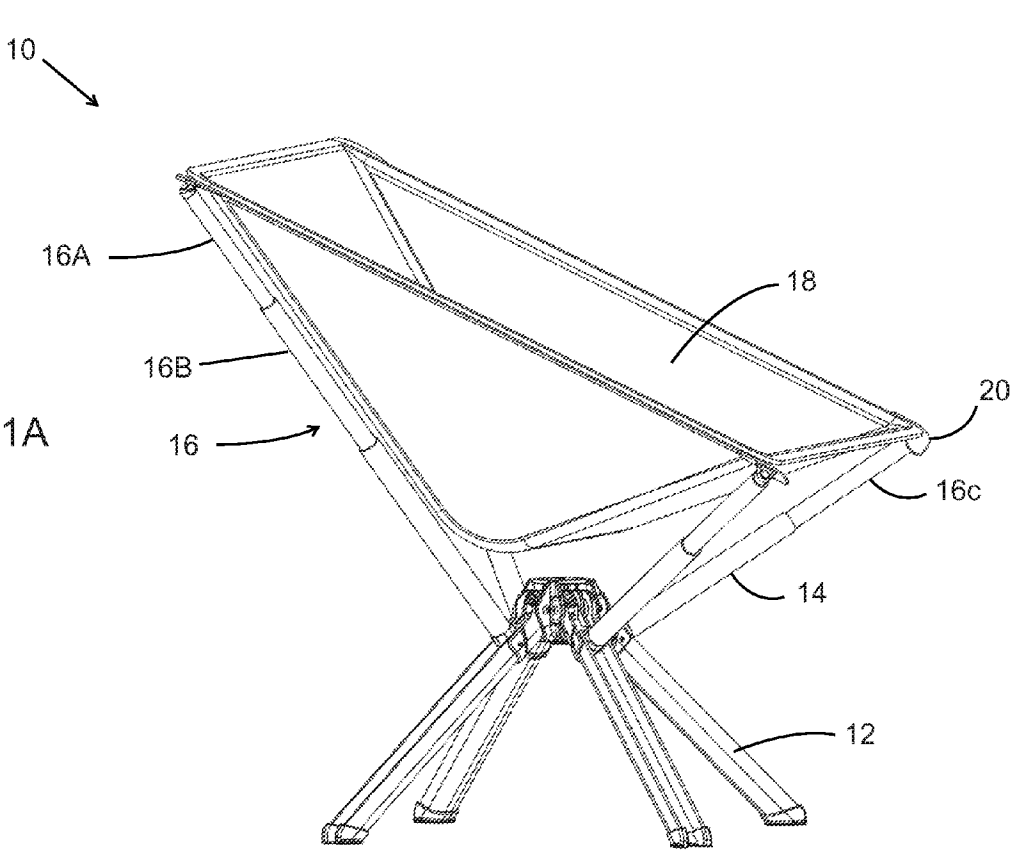
FIG. 1 shows a side perspective view of a collapsible chair with telescoping arms, in an in-use configuration, according to an exemplary embodiment of the present invention.
Figure 1A:
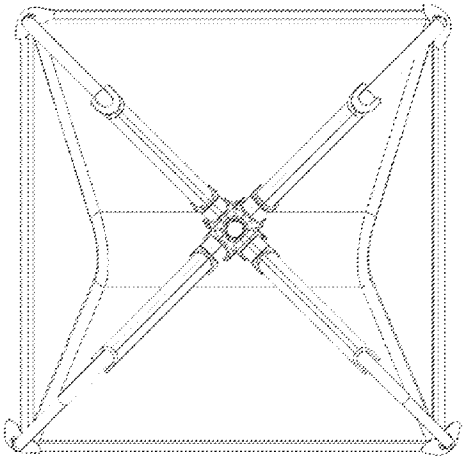
FIG. 1A shows a bottom view of the collapsible chair of FIG. 1.
Figure 1B:
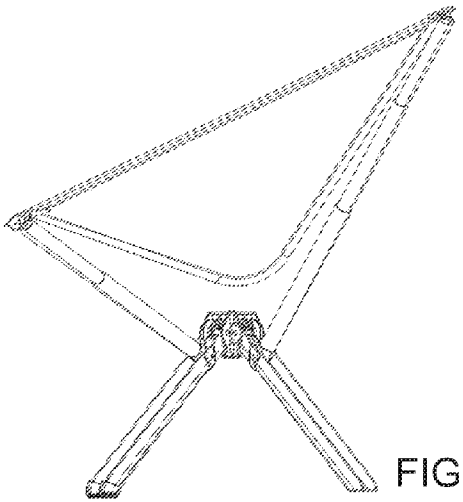
FIG. 1B shows a side view of the collapsible chair of FIG. 1.

Unless otherwise indicated illustrations in the figures are not necessarily drawn to scale.

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE PREFERRED EMBODIMENTS AND BEST MODE OF INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

As is well known to those skilled in the art, many careful considerations and compromises typically must be made when designing for the optimal configuration of a commercial implementation of any system, and in particular, the embodiments of the present invention. A commercial implementation in accordance with the spirit and teachings of the present invention may be configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

Broadly, embodiments of the present invention provide collapsible furniture that can be easily interconverted between an in-use, or deployed, configuration and a stowed configuration. A single push button may be used to cause the legs of the furniture to automatically deploy from the stowed configuration. A latch on each leg may retain the furniture in either the deployed or the stowed configurations. Arms may pivotably extending from the legs to form a seat of a chair or stool, or a top of a table, for example. The arms may telescope to form different configurations for the chair. When stowed, at least a portion of the arms are disposed within a channel formed by the legs, resulting in a compact stowed configuration. In the stowed configuration, multiple devices may join together for ease of transportation.

Figure 2:
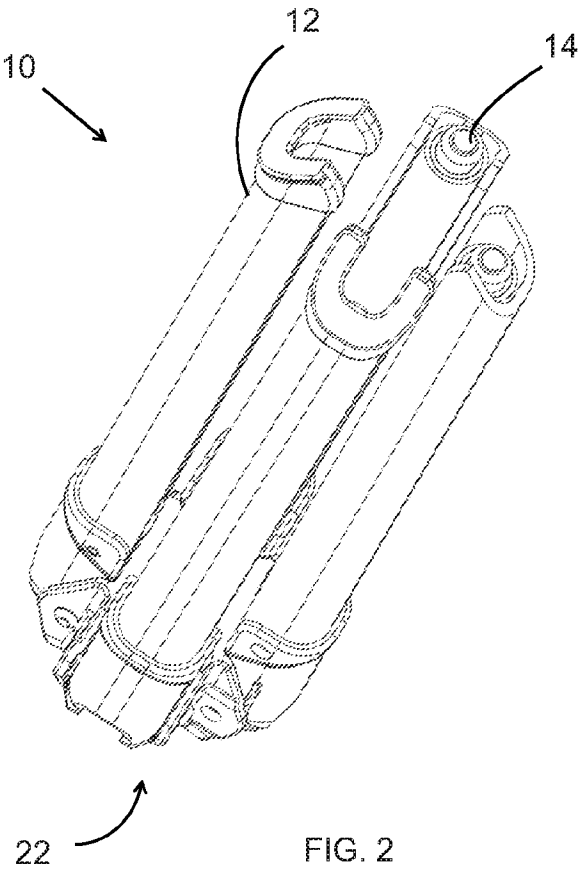
FIG. 2 shows a bottom perspective view of the collapsible chair of FIG. 1, in s stowed configuration.
Figure 2A:
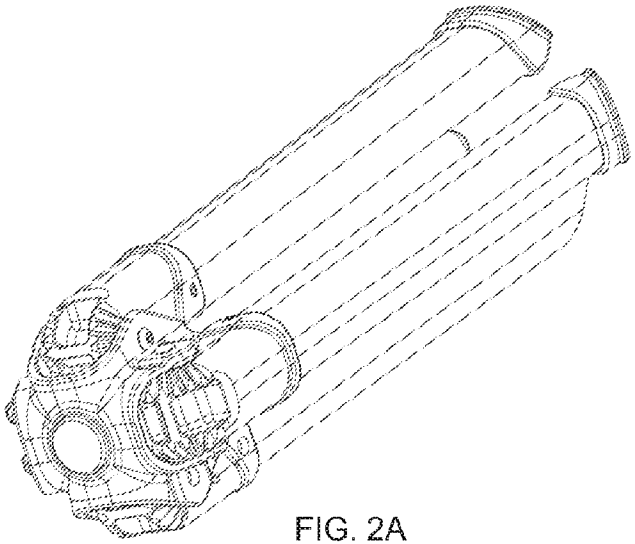
FIG. 2A shows a top perspective view of the collapsible chair of FIG. 2.
Figure 2B:
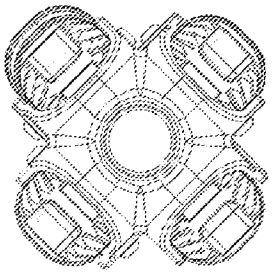
FIG. 2B shows a top view of the collapsible chair of FIG. 2.

Referring now to FIGS. 1 and 2, a chair 10 may include a plurality of legs 12 with a plurality of arms 14, where one of the arms 14 is pivotably attached to each of the plurality of legs 12. While four legs 12 and arms 14 are shown, the chair 10 may be configured with a greater number of arms 14 or legs 12 or as few as three arms 14 and legs 12. In some embodiments, the arms 14 may include one or more telescoping members 16, such as two telescoping members 16A, 16B, that extend from the arms 14. In some embodiments, the number of telescoping members 16 may be the same for each of the plurality of legs 12. In other embodiments, as shown in FIG. 1, two telescoping members 16A, 16B may be used for a back support portion of the arms 14 while a single telescoping member 16C may be used for a seat support portion of the arms 14. A seat member 18 may be attached to distal ends 20 of the arms 14 to form a seat 18 suitable for supporting a person thereupon. The seat 18 may take various forms and may be formed from various materials in various shapes. In some embodiments, the seat 18 may be permanently attached to the distal ends 20 of the arms 14, while in other embodiments, the seat 18 may be removably attached to the distal ends 20 of the arms 14.

The legs 12, as discussed in greater detail below, may pivot from a central hub 22. A push button (see FIGS. 7 and 9, for example) may be used to automatically change the chair 10 from the stowed configuration of FIG. 2 to the deployed, or in-use configuration of FIG. 1.

Figure 3:
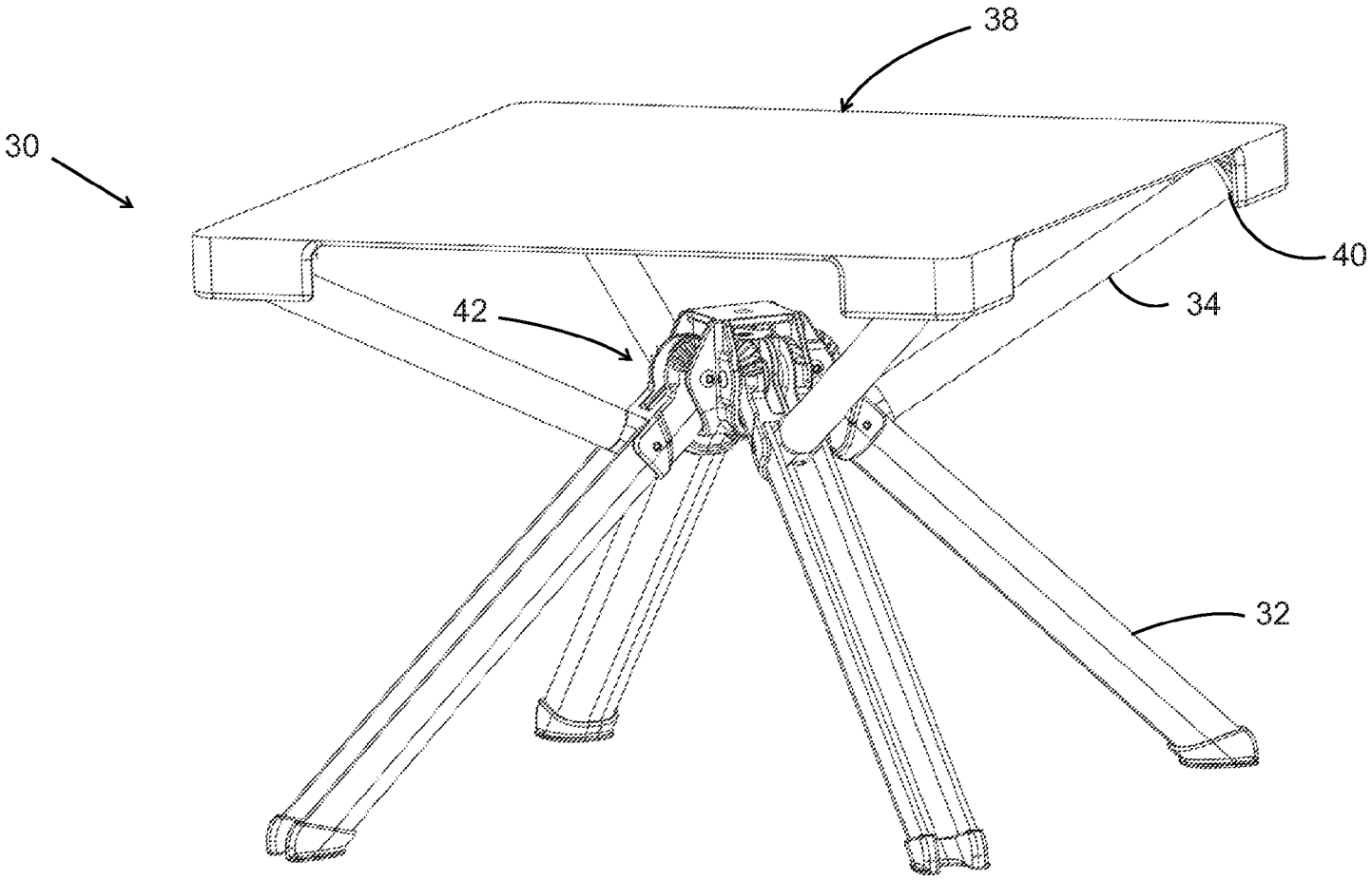
FIG. 3 shows a side perspective view of a collapsible table or stool, in an in-use configuration, according to an exemplary embodiment of the present invention.
Figure 4:
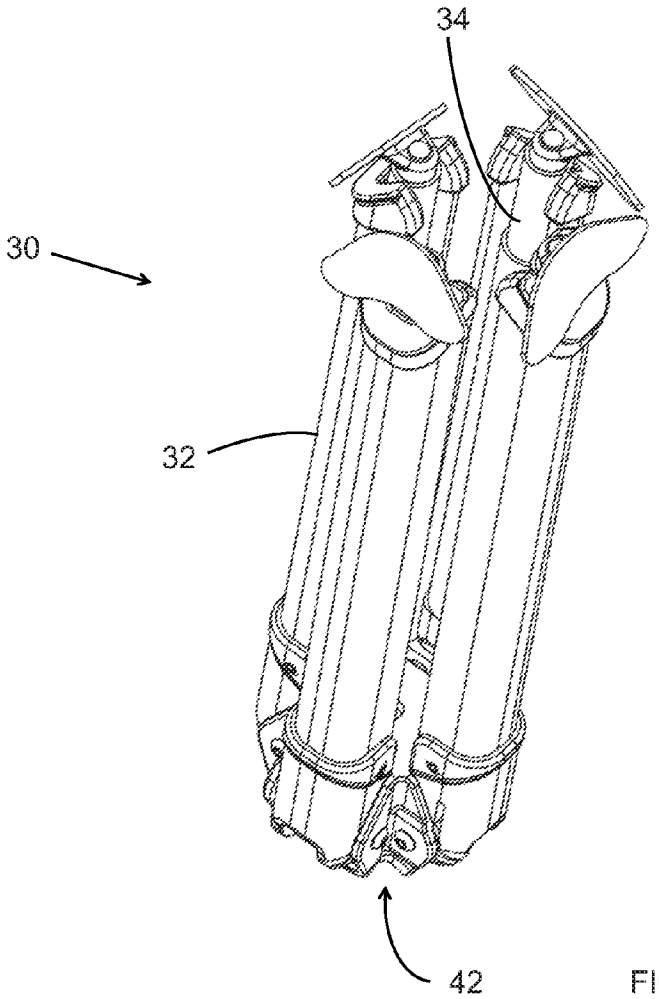
FIG. 4 shows a perspective view of the collapsible table or stool of FIG. 3 in a stowed configuration.

Referring now to FIGS. 3 and 4, a stool 30 (or table 30, depending upon application) may include a plurality of legs 32 with a plurality of arms 44, where one of the arms 34 is pivotably attached to each of the plurality of legs 32. While four legs 32 and arms 34 are shown, the stool 30 may be configured with a greater number of arms 34 or legs 32 or as few as three arms 34 and legs 32. A seat member 38 may be attached to distal ends 40 of the arms 34 to form a seat 38 suitable for supporting a person thereupon (or a table top 38 for disposing items thereupon). The seat 38 may take various forms and may be formed from various materials in various shapes. In some embodiments, the seat 38 may be permanently attached to the distal ends 40 of the arms 34, while in other embodiments, the seat 38 may be removably attached to the distal ends 40 of the arms 34.

The legs 32, as discussed in greater detail below, may pivot from a central hub 42. A push button (see FIGS. 7 and 9, for example) may be used to automatically change the stool 30 from the stowed configuration of FIG. 4 to the deployed, or in-use configuration of FIG. 3.

Figure 5:
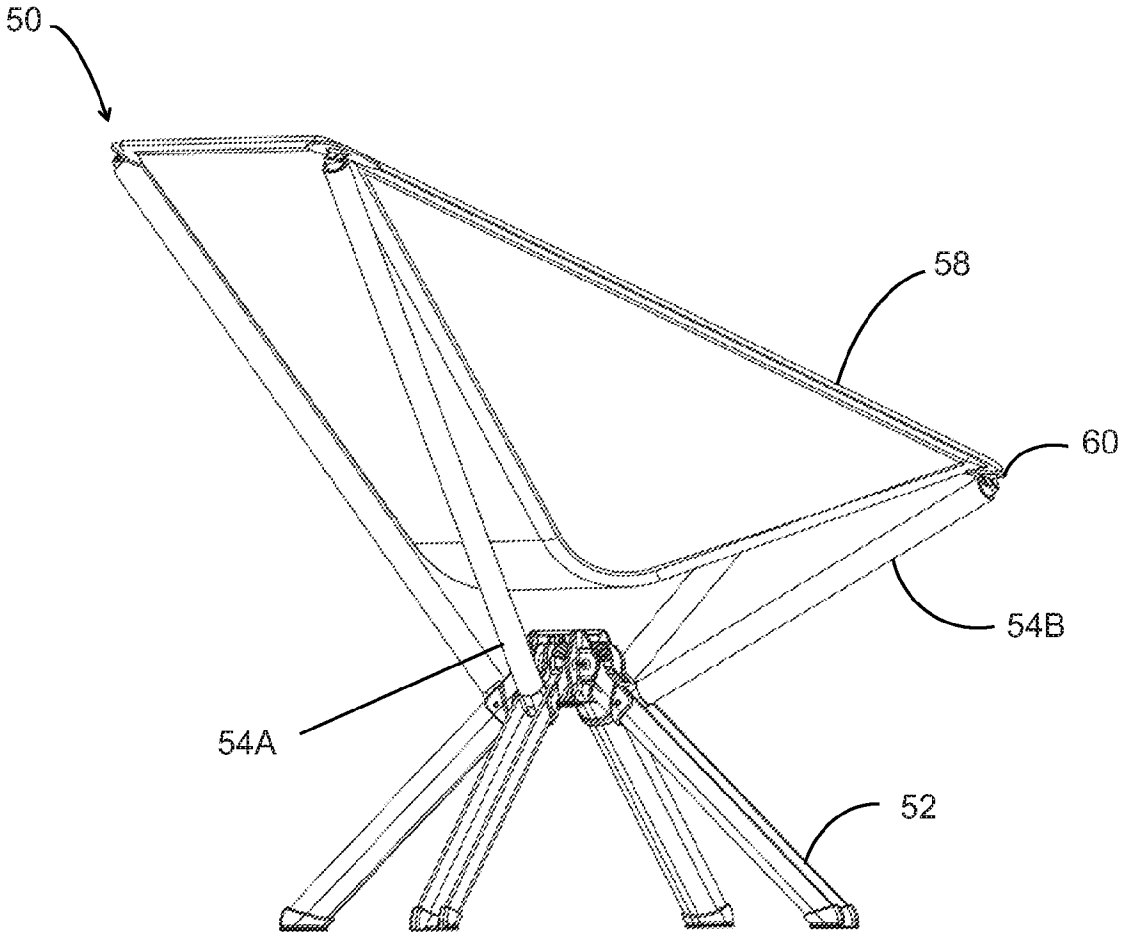
FIG. 5 shows a side perspective view of a collapsible chair, in an in-use configuration, according to an exemplary embodiment of the present invention.
Figure 6:
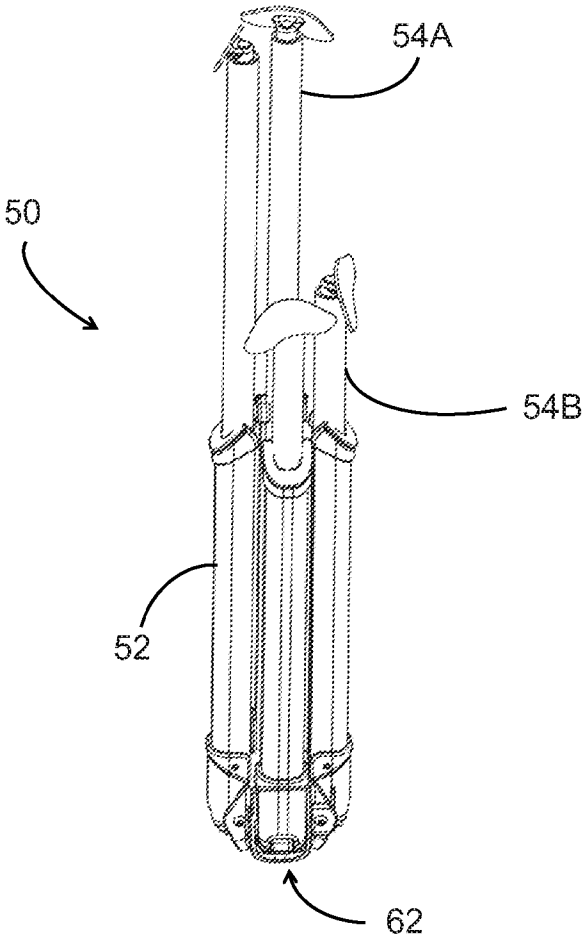
FIG. 6 shows a perspective view of the collapsible chair of FIG. 5, in a stowed configuration.

Referring now to FIGS. 5 and 6, a chair 50 may include a plurality of legs 52 with a plurality of arms 54A, 54B, where one of the arms 54A, 54B is pivotably attached to each of the plurality of legs 52. While four legs 52 and arms 54A, 54B are shown, the chair 50 may be configured with a greater number of arms 54A, 54B or legs 52 or as few as three arms 54A, 54B and legs 52. In some embodiments, the arms may include back support arms 54A and seat support arms 54B, where the back support arms 54A may be longer than the seat support arms 54B, providing a chair shape to a seat member 58. The seat member 18 may be attached to distal ends 60 of the arms 54A, 54B to form the seat member 58 suitable for supporting a person thereupon. The seat member 58 may take various forms and may be formed from various materials in various shapes. In some embodiments, the seat member 58 may be permanently attached to the distal ends 60 of the arms 54A, 54B, while in other embodiments, the seat member 58 may be removably attached to the distal ends 60 of the arms 54A, 54B.

The legs 52, as discussed in greater detail below, may pivot from a central hub 62. A push button (see FIGS. 7 and 9, for example) may be used to automatically change the chair 50 from the stowed configuration of FIG. 6 to the deployed, or in-use configuration of FIG. 5.

As can be seen from FIGS. 2, 4 and 6, the legs 12, 32, 52 may be disposed an C-shaped or U-shaped elements, where the legs 14, 34, 54A, 54B may fold at least partially into the interior of the legs.

Figure 7:
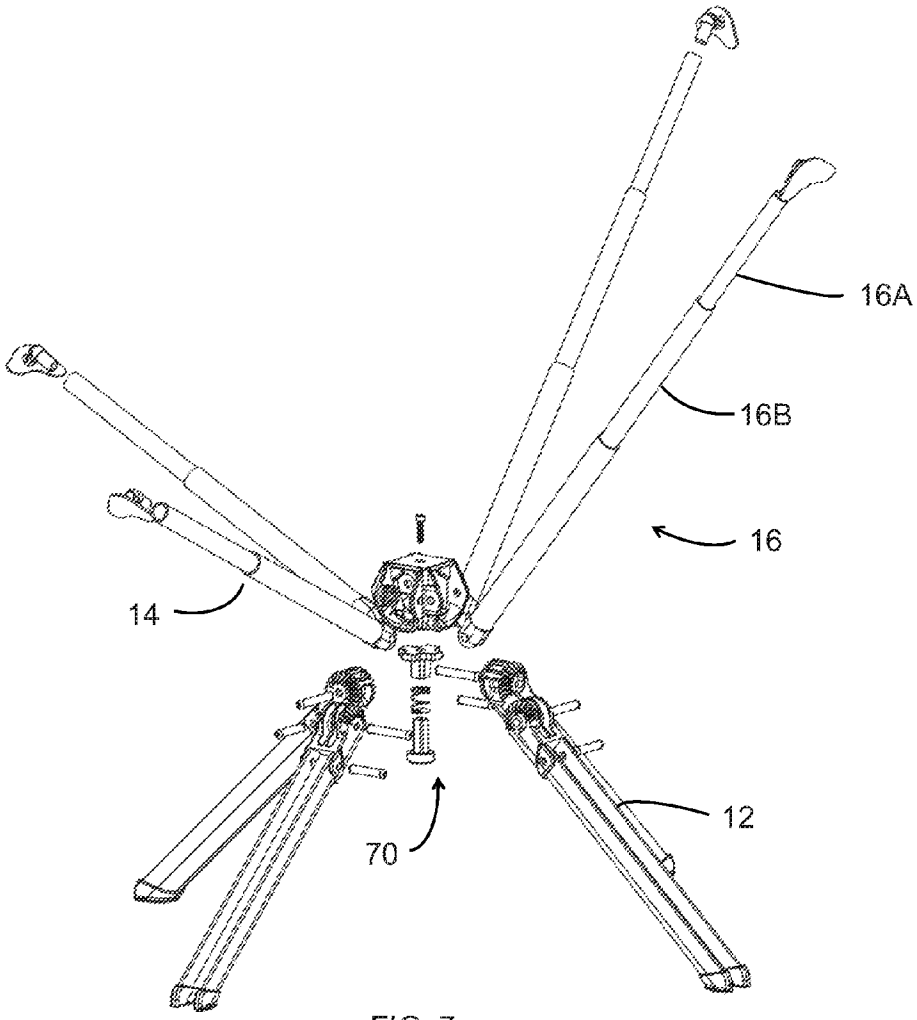
FIG. 7 shows an exploded view of the collapsible chair of FIG. 1.
Figure 8:
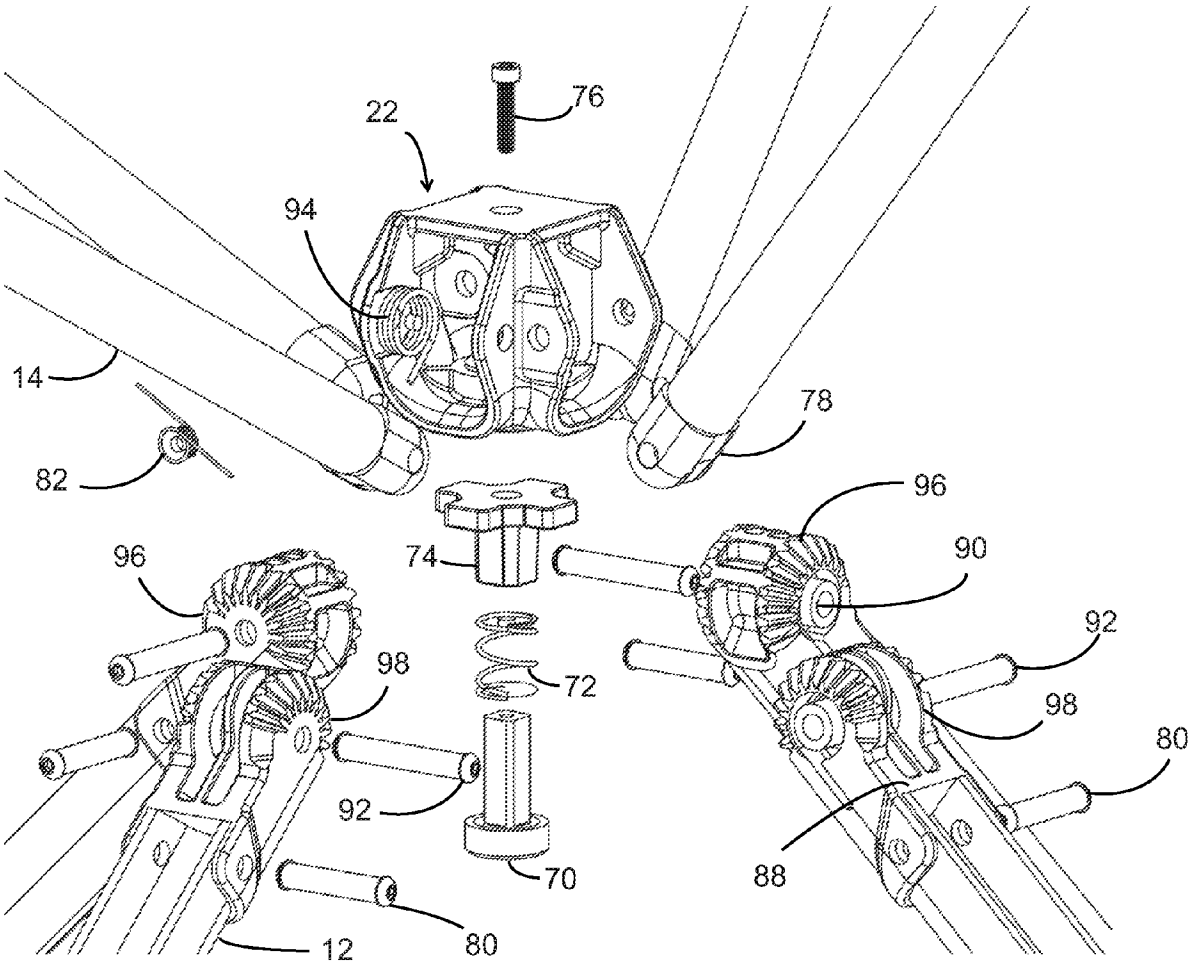
FIG. 8 shows a detailed exploded view of the collapsible chair of FIG. 1.

Referring now to FIGS. 7 and 8, a push button 70 may be disposed at a bottom of the central hub 22. A bolt 76 may attach a cross-shaped stopper 74 to the push button 70. A spring 72 may resiliently bias the stopper 74 and spring 70 at a downward, or engaged position, as discussed in greater detail below. Depressing the push button 70 causes the stopper 74 to move upward (relative to the direction on the page in FIG. 8) resiliently against the spring 72.

The legs 12 may include a through hole 90 through which a leg pivot pin 92 passes. A spring 94 may be used to resiliently urge the legs 12 into the deployed position. A deployed position catch 96 may be disposed in the end of the leg 12 to lock the legs in the deployed position with the stopper 74. A stowed position catch 98 may be disposed in the end of the leg 12 to lock the legs in the stowed position with the stopper 74. When in the stowed position, upon depressing the push button 70, the spring 94 may resiliently urge the legs 12 into the deployed position in an automatic manner.

The arms 14 may include an arm through hole 78 through which an arm pivot pin 80 passes. A spring 82 may be used to resiliently urge the arm 14 into the deployed position. In some embodiments, the arms 14 may frictionally fit, or may snap fit, for example, into the legs 12 to retain the arms 14 in the stowed position. In some embodiments, a flat portion 88 of the leg 12 may slide upward as the leg is deployed, releasing the arms 14. When the legs are folded to be deployed, the flat portion 88 may slide over a portion of the arms 14 to maintain them in the stowed position. In some embodiments, the arms 14 may be held in the stowed position simply by being encases within the folded legs 12.

Figure 9:
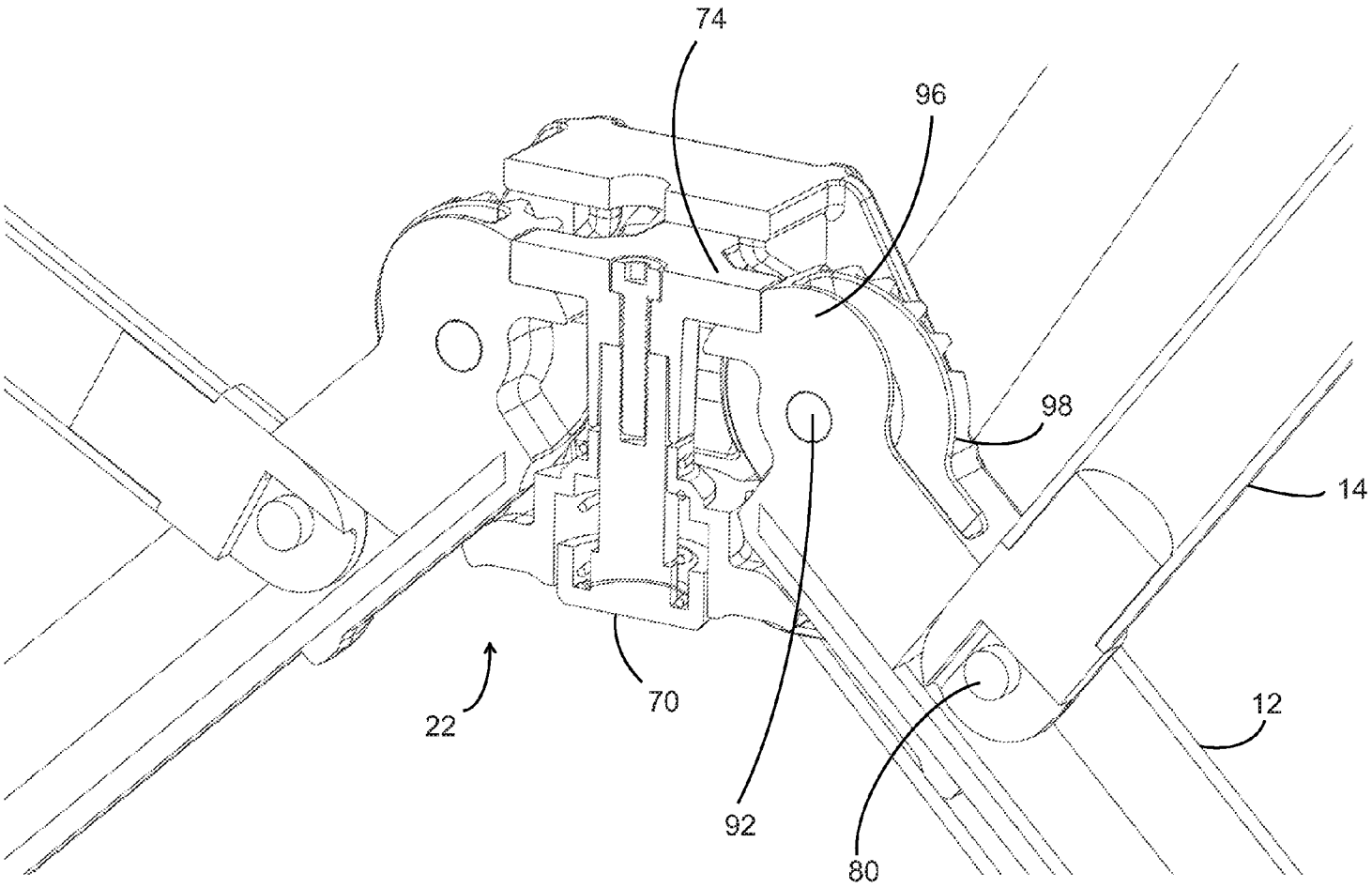
FIG. 9 shows a detailed, partially cut-away view of the junction between arms and legs of the collapsible furniture of the present invention in an in-use configuration.
Figure 10:
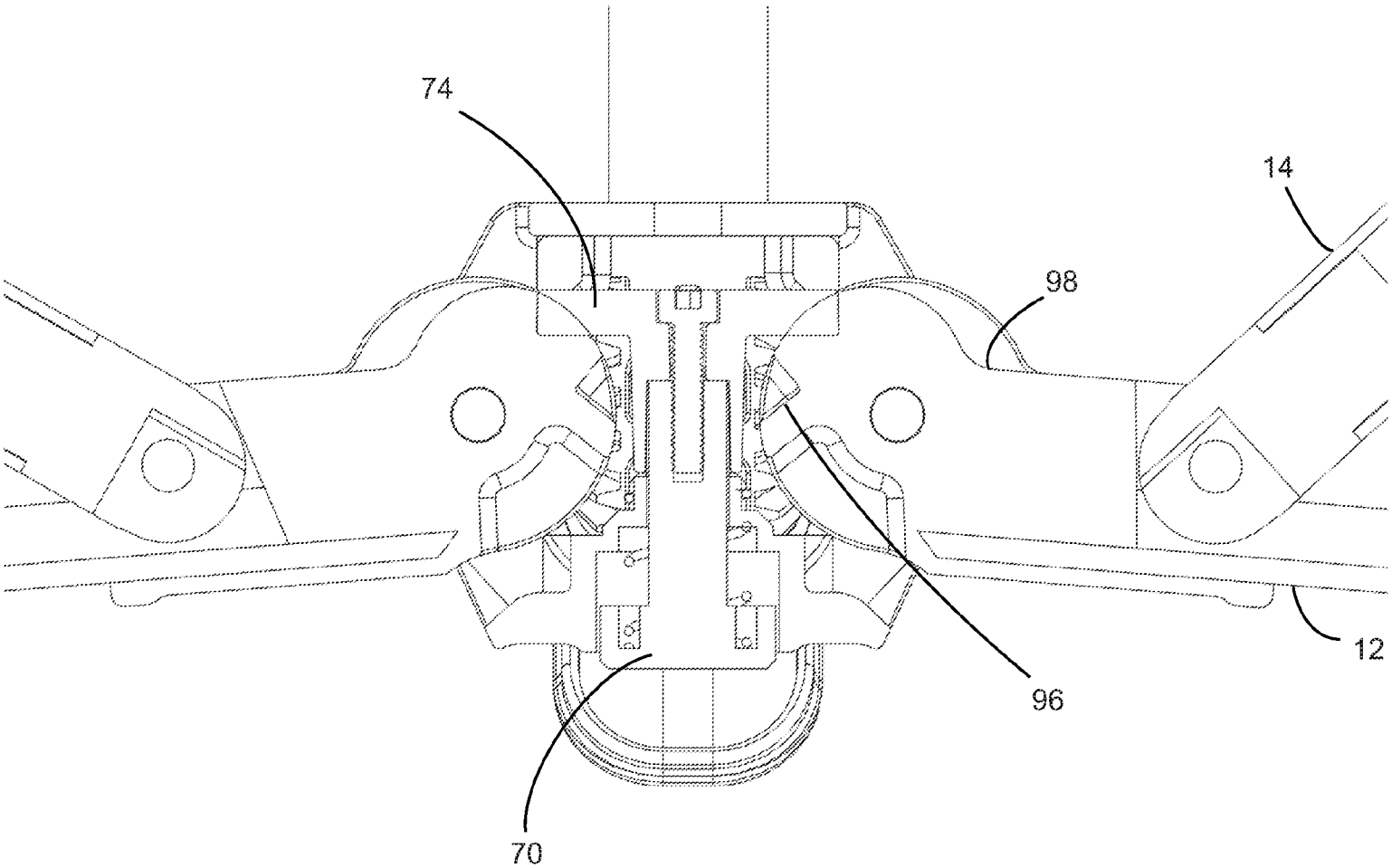
FIG. 10 shows a detailed, partially cut-away view of the junction between arms and legs of the collapsible furniture of the present invention, in an intermediate position.
Figure 11:
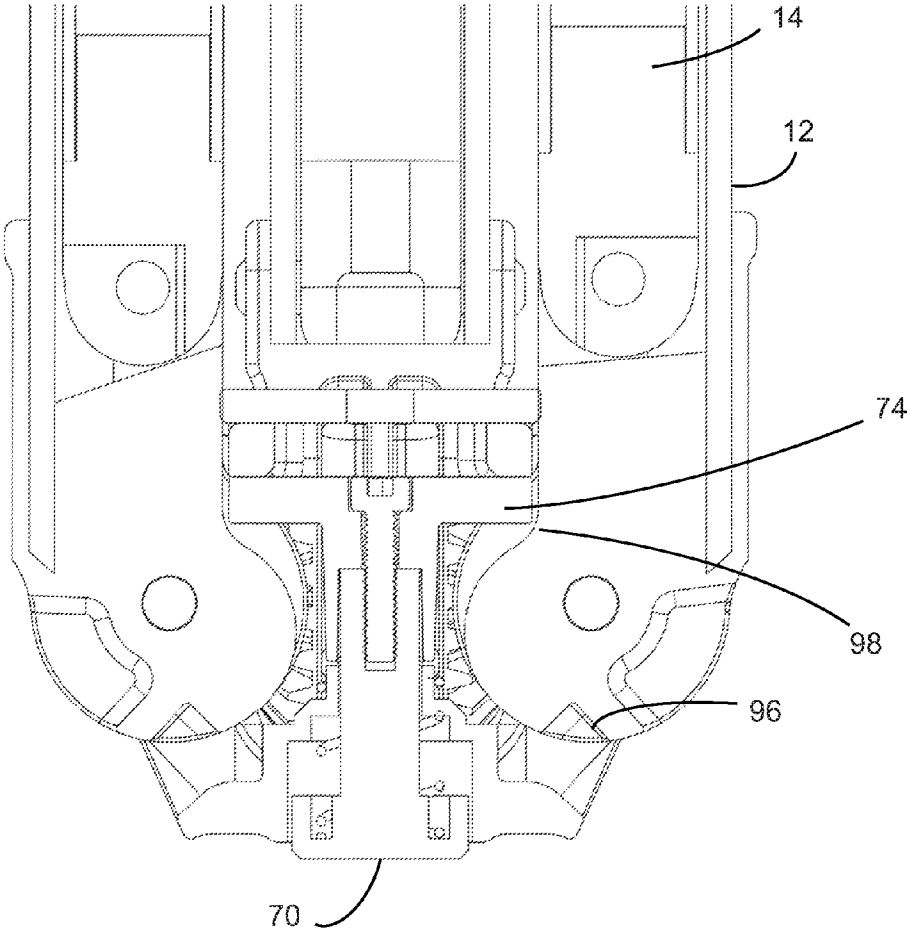
FIG. 11 shows a detailed, partially cut-away view of the junction between arms and legs of the collapsible furniture of the present invention, in a stowed configuration.
Figure 12:
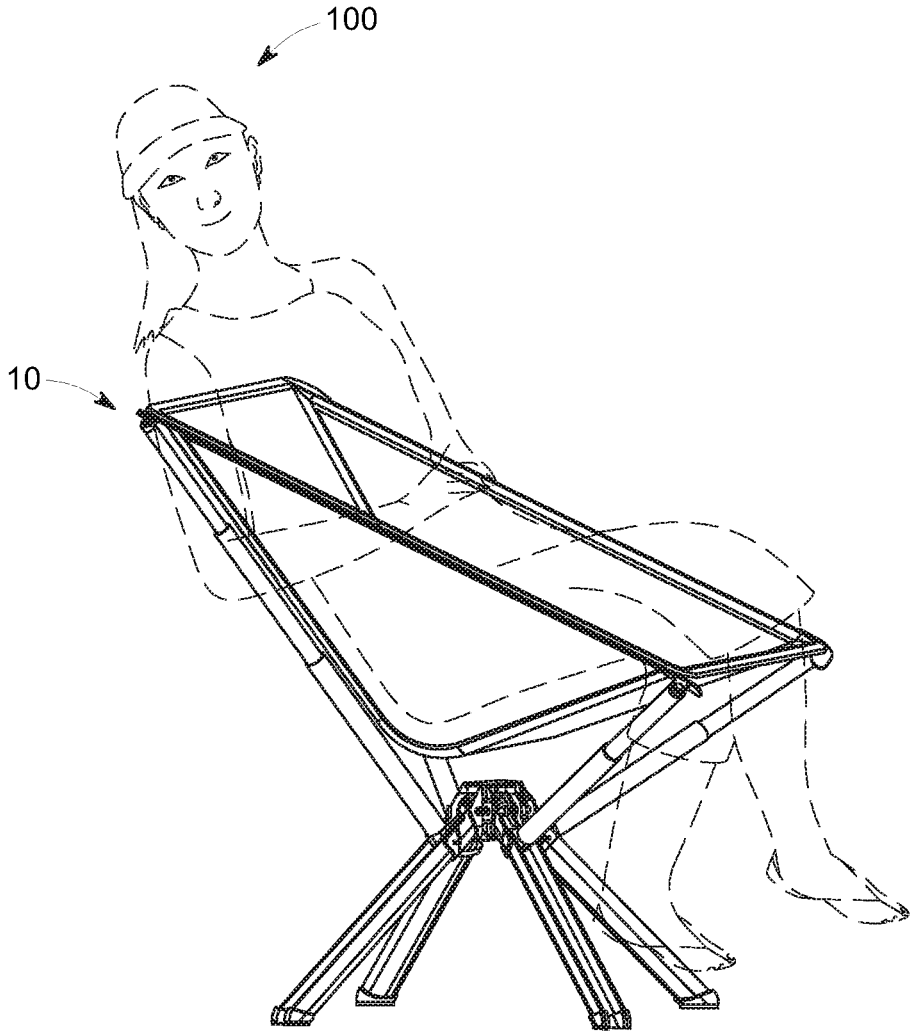
FIG. 12 shows a perspective view of the chair in use.

FIGS. 9 through 11 show movement from the deployed position (FIG. 9) to the stowed position (FIG. 11). When the push button 70 is depressed, the stopper 74 moved from the deployed position catch 96 and allows the user to move the legs 12 together toward the deployed position against the tension of the springs 94 (see FIG. 8). Once the stowed position is reached, as shown in FIG. 11, the spring 72 causes the stopper 74 to move to catch the stowed position catch 98, holding the legs 12 in the stowed position. When the push button 70 is depressed, the springs 94 cause the legs 12 to automatically open, while the springs 82 cause the arms 14 to automatically open at the same time (moving from FIG. 11 to FIG. 9).

In some embodiments, where the arms 14 include telescoping members 16A, 16B, for example, the arms may either fully deploy or may be adjustable in length, using a twist lock, a pin lock, or the like to lock the telescoping arms into a desired length. In some embodiments, a linear actuator, motor, or the like, may be used to deploy the telescoping arms to a desired position. Other mechanisms, as may be known in the art, may be used to adjust the length of the arms as desired.

In some embodiments, the legs may include geared teeth that may be used to help control the deployment of the legs, preventing the legs from deploying too rapidly, for example.

In some embodiments, the chair 10, 30, 50 may be a smart chair that may include interfacing with virtual reality gaming devices. For example, the arms and/or legs may manually adjust their length to create a sensation of movement to a user seated in the chair. Speakers may be disposed in the chair as well. In some embodiments, a subwoofer may be disposed below the central hub to not only provide support for the chair, but to also provide vibration, sound and movement sensations to a user seated therein. The speakers and/or subwoofer may be removably attached to the chair to permit the user to deploy and stow the chair, as described above, while adding features to the chair. Where the chair includes motorized features, the push button may be an electrical control button for deployment and/or stowing the chair. For virtual reality applications, the chair may include an interface to receive input from a gaming module or software to synchronize motion of the chair to the user virtual reality experience.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Claim elements and steps herein may have been numbered and/or lettered solely as an aid in readability and understanding. Any such numbering and lettering in itself is not intended to and should not be taken to indicate the ordering of elements and/or steps in the claims.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

What is claimed is:

1. A collapsible furniture item, comprising:

a central hub;

a plurality of legs pivotably attached to the central hub, the plurality of legs movable between a stowed position, where each leg of the plurality of legs is disposed adjacent each other, and a deployed position, where the plurality of legs support the central hub above a surface;

a plurality of arms pivotably attached to the plurality of legs, proximate the central hub, the plurality of arms disposed at least partially inside a channel formed by the plurality of legs in the stowed position, the plurality of arms extending outward from the plurality of legs in the deployed position; and a push button operable to release a stopper from a stowed position catch formed in each of the legs, wherein depression of the push button, when in the stowed position, causes the plurality of legs to automatically deploy and move to a deployed position.

2. The collapsible furniture item of claim 1, wherein legs include a deployed position catch to receive the stopper and retain the legs in the deployed position.

3. The collapsible furniture item of claim 1, wherein a push button spring urges the stopper to engage with the stowed position catch.

4. The collapsible furniture item of claim 1, wherein each of the plurality of legs include a leg spring resiliently urging the legs into the deployed position.

5. The collapsible furniture item of claim 1, wherein each of the plurality of arms include an arm spring resiliently urging the arms into the deployed position.

6. The collapsible furniture item of claim 1, further comprising a seat attached to distal ends of each of the plurality of arms.

7. The collapsible furniture item of claim 1, wherein at least a portion of the arms are telescoping arms.

8. The collapsible furniture item of claim 1, wherein a back support members of the arms extend a first length longer than a second length of the seat support members of the arms.

9. The collapsible furniture item of claim 1, wherein the legs are formed in a C-shape and the arms fit at least partially into the interior of the C-shape when in the stowed position.

10. A collapsible chair, comprising:

a central hub;

a plurality of legs pivotably attached to the central hub, the plurality of legs movable between a stowed position, where each leg of the plurality of legs is disposed adjacent each other, and a deployed position, where the plurality of legs support the central hub above a surface;

a leg spring disposed against each of the plurality of legs, the leg spring resiliently urging the legs into the deployed position;

a plurality of arms pivotably attached to the plurality of legs, proximate the central hub, the plurality of arms disposed at least partially inside a channel formed by the plurality of legs in the stowed position, the plurality of arms extending outward from the plurality of legs in the deployed position;

an arm spring disposed against each of the plurality of arms, the arm spring resiliently urging the arms into the deployed position;

a seat attached to distal ends of each of the plurality of arms; and a push button operable to release a stopper from a stowed position catch formed in each of the legs, wherein depression of the push button, when in the stowed position, causes the plurality of legs to automatically deploy and move to a deployed position.

11. The collapsible furniture item of claim 10, wherein legs include a deployed position catch to receive the stopper and retain the legs in the deployed position.

12. The collapsible furniture item of claim 10, wherein a push button spring urges the stopper to engage with the stowed position catch.

13. The collapsible furniture item of claim 10, wherein at least a portion of the arms are telescoping arms.

14. The collapsible furniture item of claim 10, wherein a back support members of the arms extend a first length longer than a second length of the seat support members of the arms.

15. The collapsible furniture item of claim 10, wherein the legs are formed in a C-shape and the arms fit at least partially into the interior of the C-shape when in the stowed position.

* * * * *